US006860839B1

(12) United States Patent
Dice et al.

(10) Patent No.: US 6,860,839 B1
(45) Date of Patent: Mar. 1, 2005

(54) UNIVERSAL REAR SAFETY COVER FOR TREADMILLS

(76) Inventors: Michael P. Dice, 9 Mystic Cove, Freehold, NJ (US) 07728-3724; Robert C. Hammerstone, 80 F Fairway Ct., Lakewood, NJ (US) 08701

( * ) Notice: Subject to any disclaimer, the term of this patent is extended or adjusted under 35 U.S.C. 154(b) by 49 days.

(21) Appl. No.: 10/407,511

(22) Filed: Apr. 7, 2003

(51) Int. Cl.[7] ..... A63B 22/02
(52) U.S. Cl. ..... 482/54; 482/51
(58) Field of Search ..... 482/51, 52, 54

(56) References Cited

U.S. PATENT DOCUMENTS

| | | | | |
|---|---|---|---|---|
| 4,687,196 A | | 8/1987 | Dubrinsky et al. | |
| 4,861,021 A | | 8/1989 | Edwards et al. | |
| 4,898,378 A | | 2/1990 | Edwards et al. | |
| 5,018,722 A | * | 5/1991 | Whitmore | 482/54 |
| 5,088,729 A | | 2/1992 | Dalebout | |
| 5,709,632 A | | 1/1998 | Socwell | |
| 5,820,525 A | | 10/1998 | Riley | |
| 6,050,923 A | * | 4/2000 | Yu | 482/54 |
| 6,189,846 B1 | | 2/2001 | Wang | |
| 6,350,218 B1 | * | 2/2002 | Dalebout et al. | 482/54 |
| 6,390,955 B1 | | 5/2002 | Wang et al. | |
| 6,436,009 B1 | | 8/2002 | Marucci | |
| 6,585,624 B1 | * | 7/2003 | Chen | 482/54 |
| 6,685,599 B2 | * | 2/2004 | Wang et al. | 482/54 |

OTHER PUBLICATIONS

Tsou, Running Exerciser, Pub. No. US 2003/0130094 A1.*
WU et al., Rear Safety Foot Rest of a Treadmill, Pub. No. 2004/0106503 A1.*

* cited by examiner

*Primary Examiner*—Justine R. Yu
*Assistant Examiner*—Tam Nguyen
(74) *Attorney, Agent, or Firm*—John D. Gugliotta

(57) ABSTRACT

A shield apparatus to cover and protect the exposed rear roller on exercise treadmills is provided. The shield takes the form of a "C"-shaped guard that encompasses the rear roller across its entire width. The invention fastens to the main side rails of the treadmill by the use of a fastener such as self-tapping sheet metal screws. The guard is provided in two pieces and uses a slip arrangement to accommodate treadmills of differing width.

7 Claims, 1 Drawing Sheet

UNIVERSAL REAR SAFETY COVER FOR TREADMILLS

RELATED APPLICATIONS

The present invention contains subject matter that was first described in Disclosure Document Registration 521,776 filed on Nov. 15, 2002 under 35 U.S.C. §122 and 37 C.F.R. §1.14. As such, it is respectfully requested that said Disclosure Document remain a permanent part of the file history of the present application and be relied upon during the pending prosecution, and for any other matters that may arise.

There are no previously filed, nor currently any co-pending applications, anywhere in the world.

BACKGROUND OF THE INVENTION

1. Field of the Invention

The present invention relates generally to a treadmill safety cover and, more particularly, to an adjustable safety shield adapted to be mounted to a conventional treadmill.

2. Description of the Related Art

Physical fitness and health concerns are among the areas of highest concern among Americans today. More than ever, people are frequenting health clubs and performing exercise routines at home in order to lose weight, improve muscle tone and maintain a healthy lifestyle. One important exercise machine found at health clubs and at home is the treadmill. With such a machine, a user can ensure an invigorating and consistent walking or running session regardless of the weather in a controlled situation. One common trait to many treadmills, is the exposed rear roller, which allows the user to simply roll off of the back of the treadmill at the conclusion of the exercise session. However, this exposed roller and belt present a safety hazard should clothing, shoelaces or other items become entangled. It presents an extreme safety hazard to young children who may become tempted to insert their fingers and hands into the roller while their unaware parents are using it.

A search of the prior art did not disclose any patents that read directly on the claims of the instant invention; however, the following references were considered related.

U.S. Pat. No. 6,390,955 describes a safety strip of a protection board of a treadmill.

U.S. Pat. No. 6,436,009 describes a vertical fall prevention system for treadmills.

U.S. Pat. No. 6,189,846 describes a treadmill horizontal and vertical support mechanism.

U.S. Pat. No. 5,820,525 describes a device and method for controlling a treadmill motor.

U.S. Pat. No. 5,709,632 describes a curved deck treadmill.

U.S. Pat. No. 5,088,729 describes a treadmill frame and roller bracket assembly.

U.S. Pat. No. 4,898,378 describes a safety harness on/off switch assembly for a motorized treadmill.

U.S. Pat. No. 4,861,021 describes a safety harness on/off switch assembly for a motorized treadmill.

And, U.S. Pat. No. 4,687,196 describes a treadmill assembly.

Consequently, there is a need for means by which the safety hazards associated with exposed rear rollers on exercise treadmills can be eliminated.

SUMMARY OF THE INVENTION

It is therefore an object of the present invention to provide an improved adjustable safety shield adapted to be mounted to a conventional treadmill.

It is a feature of the present invention to provide an improved treadmill cover shield, wherein shield has a laterally-adjustable body permitting universal attachment and which covers rear drive wheels and belt structures positioned rearward of a conventional treadmill tread base.

Briefly described according to one embodiment of the present invention, a shield apparatus to cover and protect the exposed rear roller on exercise treadmills is provided. The shield takes the form of a "C"-shaped guard that encompasses the rear roller across its entire width. The invention fastens to the main side rails of the treadmill by the use of a fastener such as self-tapping sheet metal screws. The guard is provided in two pieces and uses a slip arrangement to accommodate treadmills of differing width. This feature allows for the manufacture of one product that will fit a wide variety of treadmills from varying manufacturers. It is envisioned that the guard can be provided as a factory installed component on new treadmills, or be available as an aftermarket add-on for installation by the final user. The invention can be installed with a minimum of tools.

The use of the present invention allows treadmill users to protect themselves, and others nearby, especially children, from the dangers of exposed rear belt rollers in a manner, which is quick, easy and effective.

In accordance with a preferred embodiment, the present invention covers rear roller and associated belt area to prevent injuries from finger and/or clothing from becoming engaged in roller.

Further, the guard completely encompasses rear roller and associated belt area, attaches to side rail of treadmill, and adjusts in width using slide system.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
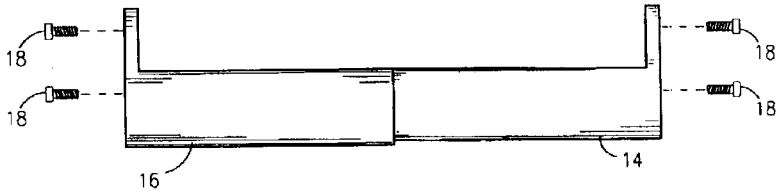
FIG. 1 is a top plan view of a universal rear safety cover for treadmills according to the preferred embodiment of the present invention.
Figure 2:
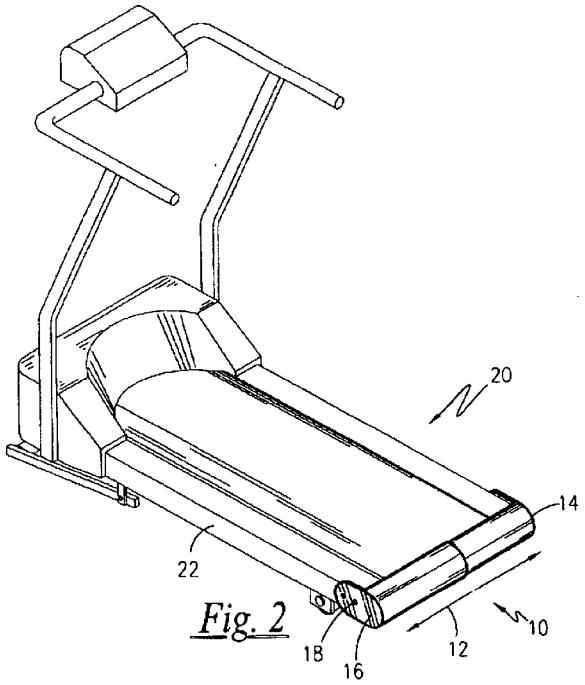
FIG. 2 is a perspective view thereof.
Figure 3:
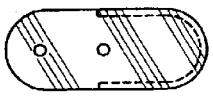
FIG. 3 is a side elevational view thereof.

Referring now to FIGS. 1-3, a safety cover for treadmills 10 is shown, according to the present invention, comprising a laterally adjustable shield having a first shield member 12 slidably engaged with a second shield member 14. Each shield member takes the form of a "C"-shaped guard that encompasses part of a rear roller of a conventional treadmill 20, such that the two engaged shield members cover the rear roller of the threadmill across its entire width and against any pinch-points such as to prevent insertion of objects, such as fingers or shoe laces, into the moving tread. Perpendicularly extending from the side of each shield member is an end cover attachment flange 16. The invention fastens to the main side rails 22 of the treadmill 20 by the use of a fastener 18 such as self-tapping sheet metal screws.

2. Operation of the Preferred Embodiment

In operation, the present invention's safety cover 10 is provided in two pieces and uses a slip arrangement to accommodate treadmills of differing width. The first shield member 12 slidably engages within the second shield member 14 in a telescoping manner. This feature allows for the manufacture of one product that will fit a wide variety of treadmills from varying manufacturers. It is envisioned that the guard can be provided as a factory installed component on new treadmills, or be available as an aftermarket add-on for installation by the final user. The invention can be installed with a minimum of tools.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A safety cover for treadmills comprising:

a laterally adjustable shield having a first end opposite a second end;

a perpendicularly extending side at said first end forming an end cover attachment flange;

a perpendicularly extending side at said second end forming an end cover attachment flange;

fastening means for affixing said end cover attachment flanges to main side rails a treadmill.

2. A safety cover for treadmills comprising:

a first shield member forming an end cover attachment flange perpendicular to a shield body;

a second shield member forming an end cover attachment flange perpendicular to a shield body;

fastening means for affixing said end cover attachment flanges to main side rails a treadmill;

said first shield member slidably engaging with said second shield member and encompassing part of a rear roller of a conventional treadmill such that the two engaged shield members cover the rear roller of the treadmill across its entire width.

3. The safety cover for treadmills of claim 2, wherein each said shield member takes the form of a "C"-shaped guard that encompasses part of a rear roller of a conventional treadmill.

4. The safety cover for treadmills of claim 3, wherein the two engaged shield members fit telescopingly with one another such as to cover the rear roller of the threadmill across its entire width.

5. In a treadmill having a treadmill belt revolving around a front roller and a rear roller, said front roller and rear roller parallelly supported apart by a pair of main side rails, wherein the improvement comprises:

a laterally adjustable shield encompassing part of said rear roller of the treadmill across its entire width.

6. In the treadmill of claim 5, wherein said laterally adjustable shield comprises:

a first end opposite a second end;

a perpendicularly extending side at said first end forming an end cover attachment flange;

a perpendicularly extending side at said second end forming an end cover attachment flange;

fastening means for affixing said end cover attachment flanges to main side rails a treadmill; and wherein each said shield member takes the form of a "C"-shaped guard.

7. In the treadmill of claim 5, wherein the two engaged shield members fit telescopingly with one another such as to cover the rear roller of the treadmill across its entire width.

* * * * *